US005630742A

United States Patent [19]

Honaker

[11] Patent Number: 5,630,742

[45] Date of Patent: May 20, 1997

[54] FLEXIBLE TOSS DEVICE

[76] Inventor: William L. Honaker, 5730 W. Milan Pl., Denver, Colo. 80235

[21] Appl. No.: 512,061

[22] Filed: Aug. 7, 1995

[51] Int. Cl.[6] ..... A63H 27/00

[52] U.S. Cl. ..... 446/46; 473/588

[58] Field of Search ..... 446/46–48; D21/85, D21/86; 273/424, 425, 428

[56] References Cited

U.S. PATENT DOCUMENTS

| | | | |
|---|---|---|---|
| D. 279,803 | 7/1985 | Manning | D21/86 |
| 693,328 | 2/1902 | Morgan | D21/86 X |
| 3,580,580 | 5/1971 | Wark | 446/48 X |
| 3,812,614 | 5/1974 | Harrington | 446/47 |
| 4,737,128 | 4/1988 | Moormann et al. | 446/46 |

*Primary Examiner*—Mickey Yu
*Attorney, Agent, or Firm*—Ancel W. Lewis, Jr.

[57] ABSTRACT

A flexible toss device disclosed has a one-piece dished body with a flat top portion and a relatively short side portion with an outer bead portion. The body is of a soft elastomer material with relatively thin, tear-resistant walls. The top portion and the side portion having sufficient rigidity so that as the side portion flexes outwardly on spinning, during flight, causes the top portion to flex down.

23 Claims, 2 Drawing Sheets

FLEXIBLE TOSS DEVICE

TECHNICAL FIELD

This invention relates to recreational devices and more particularly to a flexible, low profile, toss device.

BACKGROUND ART

A number of circular toss devices have been heretofore provided. The most common toss device presently in use is a flying device sold under the trademark FRISBEE. The flying device is usually above eight inches in diameter and usually made of a hard, rigid plastic material. The side wall is usually curved and has an inside bead. The conventional flying device is usually characterized by hardness and rigidity and therefore may damage people, animals and property during use. The flying device cannot be folded up and put in a pocket, purse or the like when not in use.

DISCLOSURE OF THE INVENTION

In accordance with the present invention there is provided a low profile, soft, circular, dished, body having relatively thin, tear resistant walls and a very short height in relation to diameter. The device can be readily propelled by gripping the side portion on the inside with the index finger and the outside against the top with the thumb in a pencil-type grip. The device is preferably propelled by a wrist action with a forward side arm throwing stroke and will travel relatively long distances with a minimal throwing force required.

BRIEF DESCRIPTION OF THE DRAWINGS

Details of this invention are described in connection with the accompanying drawings which like parts bear similar reference numerals in which.

DETAILED DESCRIPTION

Figure 1:
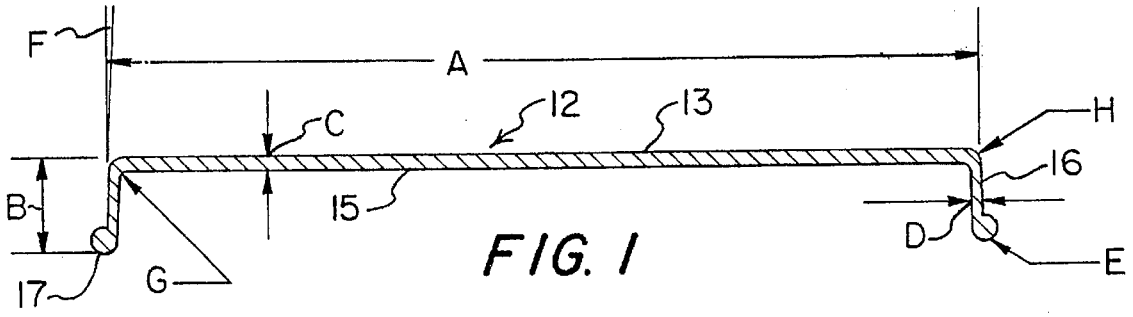
FIG. 1 is a cross sectional view of a toss device drawn to three quarters scale embodying features of the present invention.
Figure 2:
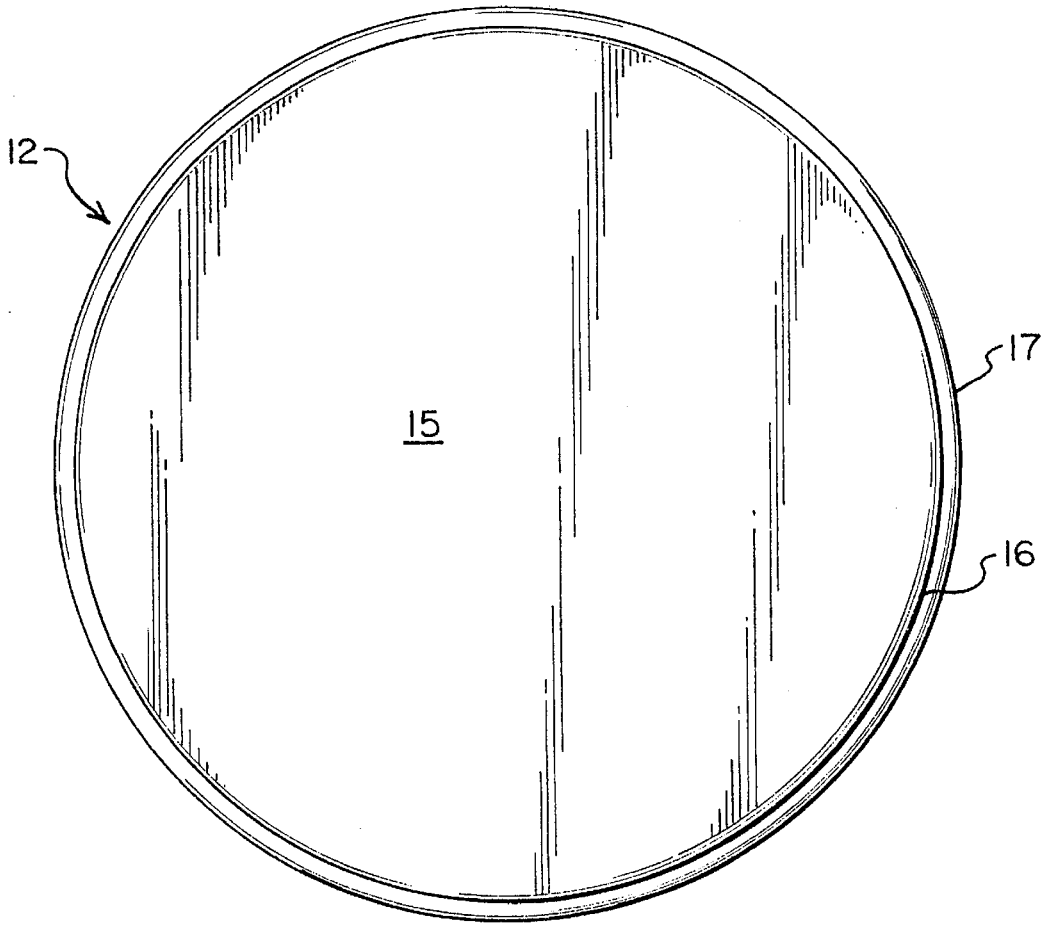
FIG. 2 is a top plan view of the device shown in FIG. 1.
Figure 3:
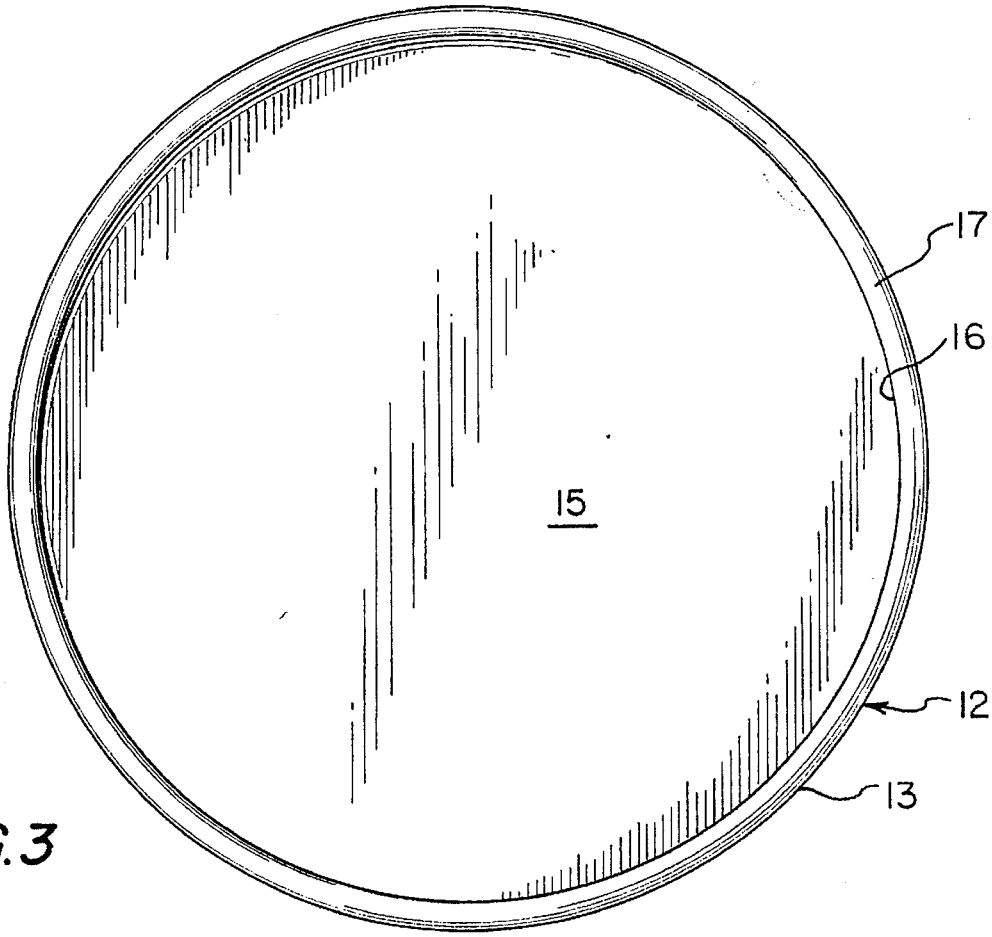
FIG. 3 is a bottom plan view of the device shown in FIG. 1.

Referring now to the drawing there is shown a toss device 12 comprised of a soft, flexible, one-piece molded, unitary, low profile, dished body 13. The body 13 has a relatively thin, flat, circumferentially continuous top portion 15 of uniform thickness and a relatively short, relatively thin, annular, circumferentially continuous side portion 16 extending down and at substantially right angles in a direction away from the top portion 15. The side portion has an outwardly projecting circumferentially continuous outside bead portion 17 along the bottom periphery.

The body 13 is preferably made of a rubber like that used in tire treads. Alternatively, the body may be formed of another elastomer exhibiting softness and capable of being molded, such as natural or synthetic rubber, EPDM, BUNA"N", neoprene or a thermal plastic elastomer (TPE) or any suitable equivalent material. A device constructed in accordance with the present invention as shown has a body with a diameter designated A of about 6.7 inches and a height designated B of about 0.73 inches. The top portion 15 has a thickness designated C of about 0.102 inches and the side portion has a thickness designated D of about 0.094 inches. The bead portion 17 has a diameter designated E of about 0.188 inches. The side portion 16 shown is inclined at a selected angle designated F to a line normal or perpendicular to the top portion of about two degrees. The inside corner designated G between the top portion 15 and side portion 16 is rounded having a radius of 0.078 inch. The outside corner designated H between the top portion 15 and side portion 16 is rounded having a radius of about 0.141 inch.

While the above dimensions have been found suitable in a device, the toss device in accordance with the present invention may vary to some extent with that of the embodiment above described. The body may have a diameter in the range of about 5.0 to 10.0 inches. The body may have a height in the range of about 0.25 to 1.50 inches. The top portion may have a thickness in the range of about 0.060 to 0.20 inches. The body may have a side portion with a thickness in the range of about 0.060 to 0.250 inches. The body may have a diameter to height ratio in the range of about 40:1 to 3:1. The bead portion may have a diameter in the range of about 0.088 to about 0.36 inches. The toss device may have an angle to the normal designated F in the range of about 1 to 4 degrees.

Figure 4:
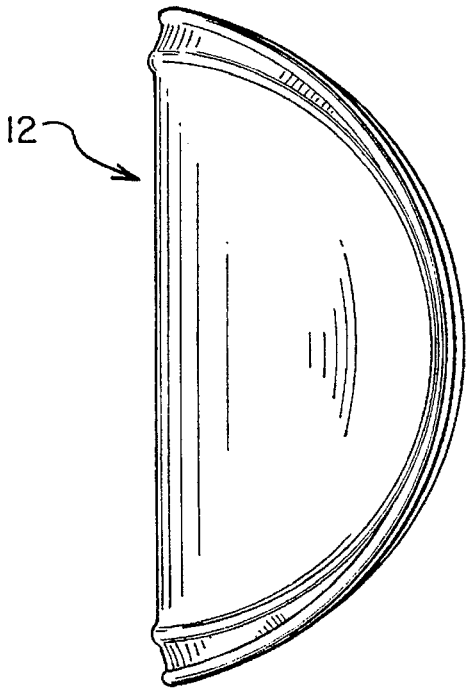
FIG. 4 is a side elevation view of the fold-up position for the device shown in FIGS. 1–3.

The toss device 12 is foldable in half along a diameter line through the center to a fold-up position as shown in FIG. 4 so as to readily fit in a pocket, bag, purse-like container or the like when not in use.

In summary, the features of a toss device made in accordance with the present invention may be described as flexible, durable, safe, not harmful to windows, easy to throw with either the backhand or a side arm, a long range such as 80 yards, the device will stall, it will curve left or right, it will skip off the pavement, it will travel in a straight line, and can be used in frisbee golf. In use the device will return to the thrower when thrown into the wind.

Figure 5:
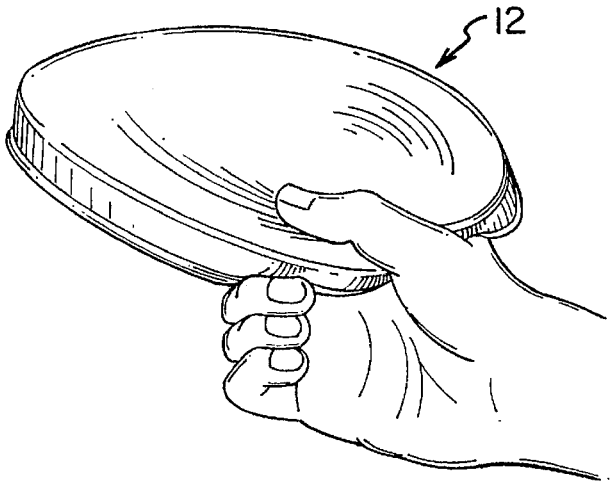
FIG. 5 is a perspective view of the toss device showing a preferred hand grip for throwing.

As shown in FIG. 5, in use the device 12 preferably is gripped much like that of a pencil grip with the index finger on the inside of the side portion 16 and the thumb on the top surface of the top portion 15 and the flexible side portion 16 is gripped between the thumb and next finger adjacent the index finger. The device is preferably propelled with a forward wrist action and side arm throwing stroke. The best results have been attained using a sharp forward wrist and arm movement. In flight the top portion 15 dishes or becomes downwardly concave and the side portion 16 flares out at a greater angle than the 2 degrees shown.

By way of example and not limitation the material of the preferred embodiment disclosed would have the following properties:

| ASTM No. | Property | Desirable Characteristics |
|---|---|---|
| P 2240 | Shore A hardness | 80 durometer |
| D 412 | Tensile strength | 3000 psi |
| | Elongation (%) | 400% |
| D 624 | Tear resistance (Die C) | 400 #/inch |
| | Weight | 0.21 lb. |

By way of example and not limitation the material of the body would have the following range of properties:

| ASTM No. | Property | Desirable Characteristics |
|---|---|---|
| P 2240 | Shore A hardness | 40–90 durometer |
| D 412 | Tensile strength | 2000–3500 psi |
| | Elongation (%) | 250–450% |
| D 624 | Tear resistance (Die C) | 150–300 #/inch |
| | Weight | 0.187 lb.–0.437 lb. |

Although the present invention has been described with a certain degree of particularity, it is understood that the present disclosure has been made by way of example and that changes in details of structure may be made without departing from the spirit thereof.

What is claimed is:

1. A flexible toss device comprising:

a flexible, one-piece, elastomer body in the form of an inverted dish having a closed, flat top wall portion, said top wall portion having a substantially flat, top surface, a substantially flat, bottom surface, said top wall portion being of substantially uniform thickness, said top wall portion having a thickness between above 0.06 to 0.20 inches, and a side wall portion having a vertical cross-section at any given point along said side wall portion extending down along a straight line from and at a slight outward angle to a line substantially normal to said top wall portion, said side wall portion having substantially straight up and down outer and inner surfaces, said side wall portion being of substantially uniform thickness, said side wall portion having a thickness between above 0.06 to 0.250 inches, said side wall portion having an outwardly projecting, circumferentially continuous outside bead portion along the outer periphery at the bottom, said top wall portion and side wall portion having sufficient rigidity so said side wall portion flexes outwardly causing said top wall portion to flex down during flight, whereby by gripping the side wall portion on the inside with the index finger and on the top surface of top wall portion with the thumb in a pencil writing type grip the device can be propelled with a forward toss throwing motion and in flight the top wall portion becomes downwardly concave and the side wall portion flares out at a greater angle to a line normal to said top wall portion.

2. A toss device as set forth in claim 1 wherein said body has a diameter of about 6.75 inches.

3. A toss device as set forth in claim 1 wherein said body has a diameter in the range of about 5.0 to less than 8 inches.

4. A toss device as set forth in claim 1 wherein said body has a height of about 0.73 inches.

5. A toss device as set forth in claim 1 wherein said body has a height of about 0.25 to 1.50 inches.

6. A toss device as set forth in claim 1 wherein said top wall portion has a thickness of about 0.102 inches.

7. A toss device as set forth in claim 1 wherein said side wall portion has a thickness of about 0.094 inches.

8. A toss device as set forth in claim 1 wherein said side portion has an outwardly projecting bead portion along the outer bottom periphery, said bead portion having a diameter of about 0.188 inches.

9. A toss device as set forth in claim 1 wherein said bead portion has a diameter of about 0.088 to 0.36 inches.

10. A toss device as set forth in claim 1 wherein said side portion inclines at a selected angle to a normal direction of about 2 degrees to the top portion.

11. A toss device as set forth in claim 1 wherein said side portion inclines at an angle to the normal of about 1 to 4 degrees.

12. A toss device as set forth in claim 1 wherein said side portion is relatively short in relation to the diameter of the top portion to provide a low profile body.

13. A toss device as set forth in claim 1 wherein the ratio of the diameter of said body to the height of said body is 6.75 to 0.73.

14. A toss device as set forth in claim 1 wherein the ratio of the diameter to the height of said body is about 40:1 to 3:1.

15. A toss device as set forth in claim 1 wherein said body has a shore hardness of about 40–80.

16. A toss device as set forth in claim 1 wherein said body has a tensile strength of about 2000–3500 psi.

17. A toss device as set forth in claim 1 wherein said body has an elongation of about 250–400%.

18. A toss device as set forth in claim 1 wherein said body has a tear resistance of about 150–300 pounds/inch.

19. A toss device as set forth in claim 1 wherein said body is made of rubber.

20. A toss device as set forth in claim 1 wherein said body is foldable in half to a fold-up position.

21. A toss device as set forth in claim 1 wherein said top wall portion and side wall portion have rounded inside and outside corners.

22. A fold-up, flexible toss device comprising:

a one-piece molded, flexible, circular, low profile body in the form of an inverted dish having a diameter less than eight inches and a height less than one inch made of a soft, tear resistant, elastomer material, said body having a thin, circular, circumferentially continuous, disc-shaped, horizontal closed, flat top wall portion of substantially uniform thickness, said top wall portion having a substantially flat, top surface, a substantially flat, bottom surface, and a thin, annular, circumferentially continuous side wall portion having a vertical cross-section at any given point along said side wall portion extending down along a straight line from and disposed substantially at a slight outward angle to a line normal to said top wall portion, said side wall portion having substantially straight up and down outer and inner surfaces, said side wall portion having an outwardly projecting bead portion of a semi-spherical shape along the outer periphery at the bottom, said top wall portion and side wall portion having sufficient rigidity so said side portion flexes outwardly causing said top wall portion to flex down during flight, whereby by gripping the side wall portion on the inside with the index finger and on the top surface of said top wall portion with the thumb in a pencil writing type grip the device can be propelled with a forward toss throwing motion and in flight the top wall portion becomes downwardly concave and the side wall portion flares out at a greater angle to a line normal to said top wall portion.

23. A fold-up, flexible toss device comprising:

a one-piece molded, flexible, circular, body, said body having a diameter in the range of about 5.0 to less than 8.0 inches and a height of about 0.25 to 1.50 inches, said body having a shore hardness of about 40–90, a tensile strength of about 2000–3500 psi, an elongation of about 250–400%, a tear resistance of about 150–300 pounds/inch, and a weight of about 0.187 lbs. to 0.437 lbs., a thin, circular, circumferentially continuous, disc-shaped, horizontal closed, flat top wall portion of substantially uniform thickness, said top wall portion having a thickness of between above 0.06 to 0.20 inches, and a thin, annular, circumferentially continuous side wall portion having a vertical cross-section at any given point along said side wall portion extending down along a straight line from and disposed substantially at an outward angle of about 1 to 4 degrees to a line normal to said top wall portion, said side wall portion having a thickness of between above 0.060 to 0.250 inches, said side wall portion having an outwardly projecting circumferentially continuous bead portion along the outer periphery at the bottom, said bead portion of a substantially semi-spherical shape and having a diameter of about 0.088 to 0.36 inches, said top wall portion and side wall portion having sufficient rigidity so said side wall portion flexes outwardly causing said top wall portion to flex down during flight, whereby by gripping the side wall portion on the inner surface with the index finger and on the top surface of said top wall portion with the thumb in a pencil writing type grip the device can be propelled with a forward toss throwing motion and in flight the top wall portion becomes downwardly concave and the side wall portion flares out at a greater angle to a line normal to said top wall portion.

* * * * *